United States Patent [19]

Amonett

[11] Patent Number: 4,575,594

[45] Date of Patent: Mar. 11, 1986

[54] TIMING MECHANISM

[75] Inventor: Daniel K. Amonett, Indianapolis, Ind.

[73] Assignee: Emhart Industries, Inc., Indianapolis, Ind.

[21] Appl. No.: 737,934

[22] Filed: May 28, 1985

[51] Int. Cl.[4] ..... H01H 43/10

[52] U.S. Cl. ..... 200/38 B; 200/38 C

[58] Field of Search ..... 200/35 R, 38 R, 38 B, 200/38 BA, 38 C, 38 CA, 38 D

[56] References Cited

U.S. PATENT DOCUMENTS

| | | | |
|---|---|---|---|
| 3,436,498 | 1/1969 | Murray et al. | 200/38 BA |
| 3,581,028 | 5/1971 | Valbona | 200/38 R |
| 3,818,157 | 6/1974 | Voland et al. | 200/38 B |
| 4,103,119 | 7/1978 | Homan et al. | 200/38 B X |
| 4,123,915 | 11/1978 | Stoor | 200/38 B X |
| 4,292,482 | 9/1981 | Smock et al. | 200/38 B X |
| 4,463,225 | 7/1984 | Obermann et al. | 200/38 B X |

*Primary Examiner*—J. R. Scott

*Attorney, Agent, or Firm*—Robert F. Meyer; Carl A. Forest

[57] ABSTRACT

A motor driven rotatable camstack includes at least two cams. A V-shaped electrical terminal blade spans the two cams. Each leg of the V-shaped electrical terminal includes a cam follower which individually engages one of the cams. Two individual spring electrical contact blades are positioned on one side of the cams to cooperate with one leg of the V-shaped electrical terminal and a single spring electrical contact blade is positioned on the other side of the V-shaped terminal to cooperate with the other leg.

3 Claims, 2 Drawing Figures

TIMING MECHANISM

BACKGROUND OF THE INVENTION

The present invention relates to a timing mechanism and more particularly to a timing mechanism that provides a single and a double upper circuit for controlling the function of an appliance.

Timing mechanisms have been used for many years to control the functions of dishwashers, washers, and dryers. In such applications, it is sometimes necessary to provide several circuits between the timing mechanism and the appliance to perform several functions. In the present invention, a single and a double upper circuit have been provided in a very simple and economical manner.

SUMMARY OF THE INVENTION

Accordingly, there is provided a timing mechanism which in general comprises a motor driven rotatable camstack which includes at least two individual cams; a V-shaped electrical terminal blade providing individual first and second legs extending from a common first electrical terminal and spanning the two individual cams, each of the first and second legs including individual cam followers, one each engaging one of the two individual cams, and an electrical contact carried at each of the first and second legs; two individual spring electrical contact blades having electrical contacts in operable position with the first leg and with each other, and each blade electrically connected to a second and third electrical terminal; and a single spring electrical contact blade having an electrical contact in operable position with an electrical contact of the second leg and electrically connected to a fourth electrical terminal.

DETAILED DESCRIPTION OF THE INVENTION

Figure 1:
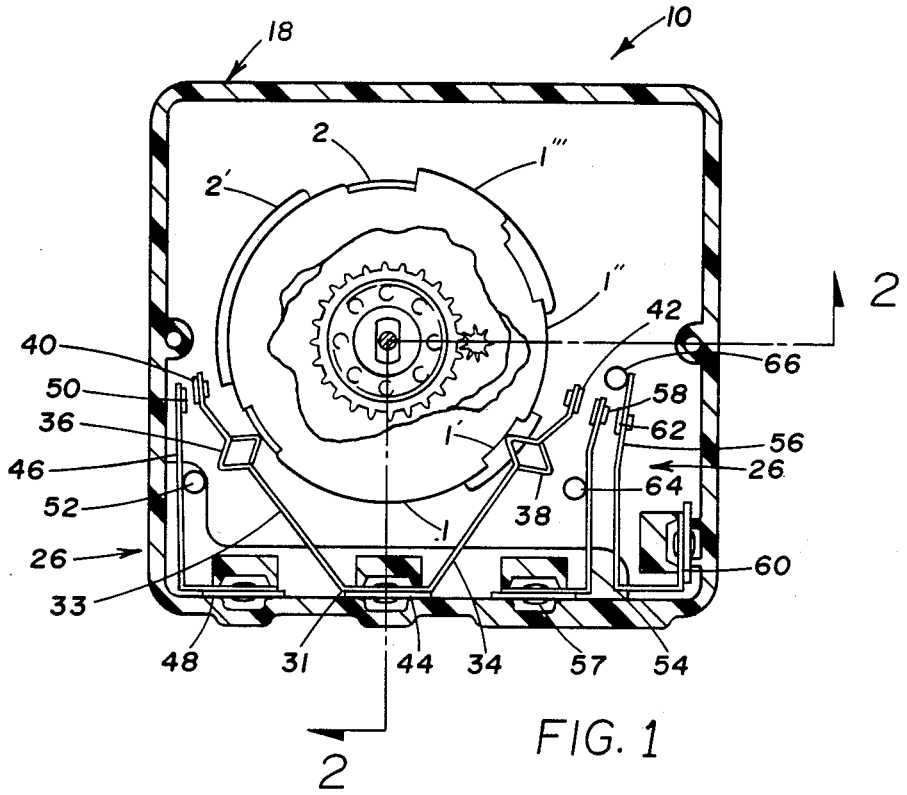
FIG. 1 is a front view of a timing mechanism showing the features of the invention.
Figure 2:
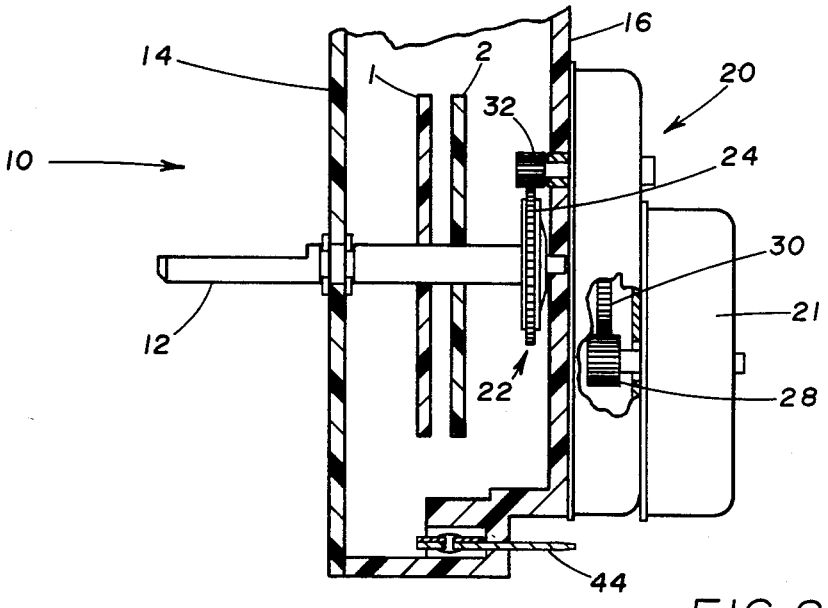
FIG. 2 is a partial section taken along the line 2—2 of FIG. 1.

Referring now to the drawings, a detailed illustration of timing mechanism 10 is shown. Timing mechanism 10, in general, includes a plurality of cams 1 and 2 carried on a cam shaft 12 which is journalled for rotation in end plate 14 and the base 16 of cup shaped housing 18, and electrical switch means 26 which individually engage the cams to be rotated thereby. The cams are rotated by a motor drive means 20 through a clutch means 22 and gear 24 which is engaged by the clutch means, gear 24 being fixedly carried on shaft 12 to cause rotation thereof. Clutch means 22 permits manual rotation of the shaft independent of the motor drive means.

Motor drive means 20 includes motor 21 having an output pinion 28 and a gear train 30 which includes a series of gears and pinions coupled between motor output pinion 28 and gear train output pinion 32. Output pinion 32 meshes with gear 24 to cause rotation of the gear and shaft 12. Rotation of shaft 12 causes rotation of cams 1 and 2 to open and close the corresponding switch means 26 to control the functions of the appliance in accordance with a program provided by the cams.

In accordance with the present invention, a single circuit and a double upper circuit is very simply and economically provided by switch means 26. A V-shaped electrical terminal blade 31 has two legs 33 and 34 spanning at least a portion of the two cams 1 and 2. Each leg has a cam follower 36 and 38 which individually engages one of the cams. In the present embodiment, follower 36 engages cam 2 while follower 38 engages cam 1. Each leg has an electrical contact 40 and 42 carried at its distal end. The V-shaped electrical blade extends from a common electrical terminal 44.

A single circuit is provided by a spring blade 46 which cooperates with leg 33. The single blade extends from an electrical terminal 48 and has an electrical contact 50 at its distal end. A stop means comprising a post 52 limits the blade's travel when the blade is in its relaxed position. When cams 1 and 2 are rotated, follower 36 will engage an outer lobe 2' to close the switch.

A double upper circuit is provided by spring blades 54 and 56 which cooperate with each other and with leg 34 of the V-shaped spring blade.

Spring blade 54 is connected to electrical terminal 57 and has an electrical contact 58 at its distal end while spring blade 56 is connected to electrical terminal 60 and has an electrical contact 62 at its distal end. Rotation of the cams causes follower 38 to leave its open position defined by step 1' and to engage lobe 1'' to close contacts 42 and 58 with further rotation causing the follower to engage lobe 1''' to cause contact 58 to also engage contact 62. Spring blades 54 and 56 are limited in their relaxed position through stop means which include posts 64 and 66.

What is claimed is:

1. A timing mechanism comprising:

(a) a motor driven rotatable camstack, said camstack including at least two individual cams, (b) a V-shaped electrical terminal blade providing individual first and second legs extending from a common first electrical terminal and spanning at least a portion of said two cams, each of said first and second legs including individual cam followers, one each engaging one of said two individual cams, and electrical contacts carried at a distal end of said legs, (c) two individual spring electrical contact blades having electrical contacts in operable position with an electrical contact of said first leg and with each other, and electrically connected to a second and third electrical terminal, and (d) a single spring electrical contact blade having an electrical contact in operable position with an electrical contact of said second leg and electrically connected to a fourth electrical terminal.

2. A timing mechanism according to claim 1 further including stop means limiting the travel of said two spring electrical contact blades in their relaxed position.

3. A timing mechanism according to claim 2 further including stop means limiting the travel of said single electrical contact blade in its relaxed position.

* * * * *